US006530560B2

(12) United States Patent
King

(10) Patent No.: US 6,530,560 B2
(45) Date of Patent: Mar. 11, 2003

(54) GUARDRAIL SUPPORT, ATTACHMENT, AND POSITIONING BLOCK

(75) Inventor: David T. King, Elizabethtown, KY (US)

(73) Assignee: K.E.S.S. Inc., Elizabethtown, KY (US)

( * ) Notice: Subject to any disclaimer, the term of this patent is extended or adjusted under 35 U.S.C. 154(b) by 0 days.

(21) Appl. No.: 10/079,280

(22) Filed: Feb. 20, 2002

(65) Prior Publication Data

US 2002/0081152 A1 Jun. 27, 2002

Related U.S. Application Data

(63) Continuation-in-part of application No. 10/001,903, filed on Nov. 15, 2001.
(60) Provisional application No. 60/249,037, filed on Nov. 15, 2000.

(51) Int. Cl.[7] ..... E01F 15/00
(52) U.S. Cl. ..... 256/1; 256/13.1; 404/6
(58) Field of Search ..... 404/6, 9; 256/1, 256/13.1

(56) References Cited

U.S. PATENT DOCUMENTS

| | | | | |
|---|---|---|---|---|
| 1,922,878 A | * | 8/1933 | Boyle | 256/13.1 |
| 2,056,842 A | | 10/1936 | Edgecomb | |
| 2,603,455 A | | 7/1952 | Welch | |
| 2,701,127 A | | 2/1955 | Elliot | |
| 3,317,189 A | | 5/1967 | Rubenstein | |
| 3,360,244 A | | 12/1967 | Bucker | |
| 3,493,213 A | | 2/1970 | Ackerman | |
| 3,591,144 A | | 7/1971 | Iving | |
| 3,603,562 A | | 9/1971 | Glaesener | |
| 3,704,861 A | | 12/1972 | Glaesener | |
| 3,784,167 A | | 1/1974 | Glaesener | |
| 3,825,218 A | | 7/1974 | Krumbein et al. | |
| 3,825,229 A | | 7/1974 | Bartlett et al. | |
| 3,963,218 A | | 6/1976 | Glaesener | |
| 3,982,735 A | | 9/1976 | Fornells | |

(List continued on next page.)

OTHER PUBLICATIONS

Exhibit A—Letter (LNG–14) from Creative Building Products Division of Spirit of America corporation, 4307 Arden Drive, Fort Wayne, IN 46804 from U.S. Department of Transportation's Federal Highway Adminstration regarding Recycled Plastic Highway Spacer Block and composition of same dated Mar. 26, 1996, pp. 1–4.
Exhibit B—HWYCOM Highway Composites Product Brochure regarding Fiberglass Breakaway Sign Supports and Barricades an internet publication at http://www.hwycom/products.htm dated Mar. 26, 2001, pp. 1–3.
Exhibit C—Bryson Products, Inc.'s Product Information Brochure, regarding Plastic Block Fabrication an internet publication at http://www.guardrails.com/company.html dated Sep. 12, 2001, pp. 1–5.

(List continued on next page.)

*Primary Examiner*—Gary S. Hartmann
(74) *Attorney, Agent, or Firm*—Carrithers Law Office; David W. Carrithers

(57) ABSTRACT

A guardrail support, attachment and positioning block used to space guardrails from support posts is disclosed. The positioning or spacer block is a generally rectangular block having corded-out cavities to reduce weight and tabs or projections for cooperatively engaging the sides and top of a support post as well as the edges of the guardrail during roadway safety barrier system installation. Webbing within one or more of the cavities may be used for additional structural support. To optimize the strength to weight characteristics of the spacer block, the spacer block may be formed by low-pressure injection molding. The spacer block may also be formed from virgin and/or recycled plastic material and/or include virgin or recycled rubber material, such as that obtained from the regrind of used tires, and/or another elastomeric materials from other sources.

16 Claims, 6 Drawing Sheets

U.S. PATENT DOCUMENTS

| | | | | |
|---|---|---|---|---|
| 4,047,701 | A | 9/1977 | Glaesener | |
| 4,090,694 | A | 5/1978 | Vincent | |
| 4,138,093 | A | 2/1979 | Meinzer | |
| 4,298,075 | A | 11/1981 | Sweeney | |
| 4,312,600 | A | 1/1982 | Schaaf et al. | |
| 4,406,563 | A | 9/1983 | Urlberger | |
| 4,553,875 | A | 11/1985 | Casey | |
| 4,684,107 | A | 8/1987 | Robbins, Jr. | |
| 4,739,971 | A | 4/1988 | Ruane | |
| 4,986,694 | A | 1/1991 | Delamere | |
| 5,069,576 | A | * 12/1991 | Pomero | 404/6 |
| 5,152,507 | A | 10/1992 | Lee | |
| 5,195,727 | A | 3/1993 | Liao et al. | |
| 5,203,543 | A | 4/1993 | Fleury | |
| 5,219,241 | A | 6/1993 | Picton | |
| 5,261,647 | A | 11/1993 | Venegas, Jr. et al. | |
| 5,277,516 | A | 1/1994 | Strieter | |
| 5,284,236 | A | 2/1994 | Ohta et al. | |
| 5,336,016 | A | 8/1994 | Baatz | |
| 5,402,987 | A | 4/1995 | Duyck et al. | |
| 5,429,449 | A | 7/1995 | Baatz | |
| 5,503,496 | A | 4/1996 | Voigt | |
| 5,507,473 | A | 4/1996 | Hammer et al. | |
| 5,791,811 | A | 8/1998 | Yoshino | |
| 6,007,269 | A | 12/1999 | Marinelli | |
| 6,010,275 | A | 1/2000 | Fitch | |
| 6,036,399 | A | 3/2000 | Schaek | |
| 6,168,346 | B1 | 1/2001 | Ernsberger | |
| 6,308,936 | B1 | * 10/2001 | Atwood | 256/13.1 |

OTHER PUBLICATIONS

Exhibit D—Bryson Products, Inc.'s Interdepartmental Memo regarding recycled/synthetic guardrail blockouts from Bryson to District Construction Engineers of Mississippi Department of Transportation dated Mar. 18, 1999, p. 1.

Exhibit E—Bryson Products, Inc.'s Letter regarding recycled/synthetic guardrail blockouts from Alabama Deparment of Transportation to Bryson Products, Inc. dated Aug. of 1988, p. 1.

Exhibit F—Bryson Products, Inc.'s Letter regarding recycled/synthetic guardrail blockouts from North Carolina Department of Transportation to Bryson Products, Inc. dated Nov. 18, 1998, p .1.

Exhibit G—Bryson Products, Inc.'s Product Bulletin regarding a RE–BLOCK (Recycled Plastic Block) obtained from the internet at http://www.guardrails.com/catalog/re-block.html and dated Sep. 12, 2001, pp. 1–3.

Exhibit H—Mondo Polymer Technologies, Inc. Letter from U.S. Department of Transporation's Federal Highway Administration regarding Polyethylene Polymer Offset Blocks dated Mar. 11, 1997, pp. 1–5.

Exhibit I—Mondo Polymer Technologies, Inc. Product bulletin No. 1097 MPT 100 regarding Polyethylene Polymer Offset Blocks date not available, pp. 1–4.

Exhibit J—Material Safety and Data Sheet from Polymer Process Technologies, Inc., whose address is 371 Kelly Avenue, Akron, OH 44306, for PPT–SYS (R) Product for Rubber Applications and PPT–SYS (P) for Plastic Applications, dated Jun. 28, 1999, pp. 1–5.

Exhibit K—Material Safety and Data Sheet from Polymer Process Technologies, Inc., whose address is 171 Kelly Avenue, Akron, OH 44306, for PPT–RNU Product dated Jun. 24, 1999, pp. 1–7.

* cited by examiner

GUARDRAIL SUPPORT, ATTACHMENT, AND POSITIONING BLOCK

RELATED APPLICATIONS

This application is a continuation-in-part of U.S. patent application Ser. No. 10/001,903, filed Nov. 15, 2001 and entitled "Guardrail Support, Attachment, and Positioning Block" which claimed priority from U.S. provisional application Ser. No. 60/249,037, filed on Nov. 15, 2000.

TECHNICAL FIELD OF THE INVENTION

The present invention relates generally to highway safety systems and, more particularly, to spacer blocks for attachment of guardrails to support posts.

BACKGROUND OF THE INVENTION

Guardrails are typically installed along highways as components in roadway safety barrier systems. The guardrails commonly used are usually formed as strips of material, typically twelve (12) gauge galvanized steel. Other materials commonly used in guardrail fabrication include aluminum, steel, fiberglass, or even synthetic materials. Most segments of guardrail are approximately twelve (12) feet in length and about ninety (90) pounds in weight.

At least one configuration of a guardrail used includes a corrugation forming an undulating cross section. The undulating cross section is employed in its capacity to absorb energy from the impact of an out of control vehicle. Such energy absorption is desired in an effort to prevent the vehicle from leaving the roadway or at least to influence the direction of the vehicle prior to it leaving the roadway. Typically, corrugated beams are about nine (9) inches wide, have two crowns and are shaped substantially like the letter "W". An alternate corrugated guardrail embodiment is known in the industry as a thrie-beam guardrail. Thrie-beam guardrails typically have three crowns and are generally about one-third (⅓) wider than a conventional, two-crown, or "W", guardrail.

In most roadway safety barrier systems, a plurality of guardrails are typically linked together at their distal ends, either end to end, or overlapping, and are supported by a plurality of vertically oriented support posts. Among the support post configurations typically used are "I-beam," round or square posts. The support posts used may be fabricated from a variety of materials including wood, metals such as aluminum, steel, etc. Some support posts may also be formed from polymer or fiberglass materials. In place, driven into the ground a distance from the edge of the roadway and from one another, the support posts will typically yield under a certain amount of pressure either by moving within the ground or by bending in accordance with the deformation of the guardrail. Preferably, the support posts do not break off at ground level. Yielding or bending is preferred in an effort to assist the guardrail in dissipating the impact force received from an out of control vehicle.

In a typical roadway safety barrier system, a spacer block is disposed between the guardrail and the support post such that the guardrail may be maintained a distance from the support post. The spacing provided by the spacer block preferably helps keep an automobile's wheels from coming into contact with the support posts and initiating a roll of the vehicle. In addition, the guardrail provides a rail or track for guiding the vehicle and providing at least some response time for the driver to regain control of the vehicle.

Conventional spacer blocks are typically made of wood. However, wood as a material for spacer blocks has many shortcomings. Among wood's shortcomings as a spacer block material are that it deteriorates over time, it is excessively heavy, it can give installers splinters and it typically contracts and expands with seasonal changes. In addition, wood tends to leach out the chemicals typically used for pressure treatment, which chemicals may be toxic to the environment. While there are some plastic spacer block substitutes on the market, they are generally deficient in that they are typically wood block designs formed from plastic.

In most installation instances, it requires two to three people to attach a twelve (12) foot section of guardrailing to support posts when using conventional spacer blocks. In the effort, installation typically requires one person to hold the guardrail while another person aligns and holds the spacer block in position. A third person is often required to insert bolts or other attachment means through each system piece for securitization thereof.

SUMMARY OF THE INVENTION

In accordance with teachings of the present disclosure, a guardrail support, attachment and positioning block is provided. In one embodiment, the block preferably includes a pair of side-walls coupled to a top and a bottom panel, thereby forming a generally rectangular block having first and second faces. The block preferably further includes, among other components, at least one mounting bore for coupling a guardrail to a support post. The block preferably also includes an engagement mechanism operable to engage the block with the support post and a resting mechanism operable to support the guardrail during assembly.

In another aspect of the present invention, a method of manufacturing a spacer block for attaching a guardrail to a support post is provided. The method preferably includes forming a block, forming a first aperture through the block and positioning an engagement mechanism on the block, the engagement mechanism preferably being operable to retain the block proximate a mounting position during assembly of a roadway safety barrier system.

In yet another aspect, the present invention provides a guardrail support assembly. The guardrail support assembly preferably includes a support post and a spacer block. The spacer block preferably includes, among other characteristics, a top tab operable to engage the support post and maintain the spacer block in position.

In a further aspect, the present invention provides a method for assembling a roadway safety barrier system. The method preferably includes, among other steps, engaging a tab on a spacer block with a support post such that the spacer block is retained proximate a mounting position. The method preferably also includes engaging at least a portion of a guardrail with a support mechanism on the spacer block such that the guardrail segment may be retained in position proximate the mounting position.

In another aspect the present invention provides a roadway safety barrier system. The roadway safety barrier system preferably includes a guardrail, a support post and a spacer block coupled together by one or more attachment mechanisms. The spacer block preferably includes, among other elements, a positioning mechanism operable to depend the spacer block from the support during assembly of the roadway safety barrier system.

Further, the present invention provides a spacer block having improved strength, reduced weight, and competitive cost. In addition, the spacer block of the present invention, designed with the assembly process in mind, enables an individual installer to erect and install a guardrail safety barrier system using spacer blocks supported by posts.

Plastic properties are different from those of wood. The present invention takes advantage of these different properties through the use of a new spacer block design. The spacer block of the present invention may employ plastic (polyethylene, PVC, polypropylene polyethylene terephthalate, nylon), plastic/rubber, as well as other materials in its construction. Through the use of such materials, the present invention provides a more resilient, elastic and flexible spacer block that is generally impervious to weathering, has increased longevity, and requires little or no maintenance once installed.

It is an object of the present invention to provide a spacer block enabling one person to install a roadway safety barrier system.

It is another object of the present invention to provide a spacer block which is splinter-less, has a longer life span and is lighter than wood.

It is yet another object of the present invention to provide a plastic/rubber composite spacer block that meets all required specifications set forth by the Federal Highway Administration.

It is still another object of the present invention to provide a spacer block that is environmentally friendly and capable of being manufactured using recycled plastic, tires, and/or combinations thereof.

It is still another object of the present invention to provide a plastic-rubber composite spacer block that will meet or exceed the capabilities of today's wooden block.

Yet another object of the present invention is to provide a spacer block embodiment that may be formed from structural foam in order to optimize the weight to strength characteristics of the spacer block.

Other objects, features, and advantages of the invention will be apparent from the following detailed description taken in conjunction with the accompanying drawings showing a preferred embodiment of the invention.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION OF THE INVENTION

Preferred embodiments of the invention and its advantages are best understood by referring to FIGS. 1 through 15 of the drawings, like numerals being used for like and corresponding parts of the various drawings.

Figure 1:
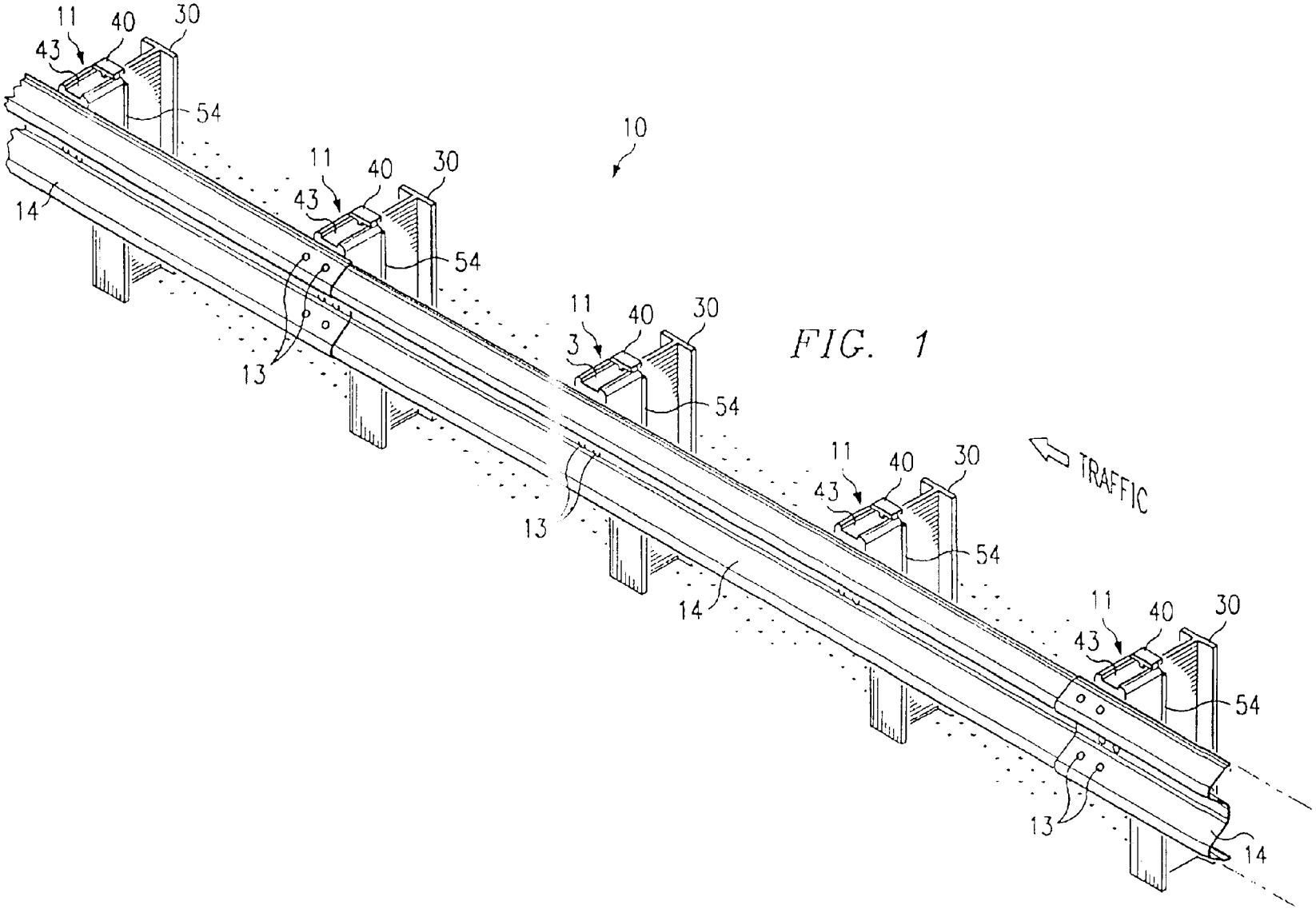
FIG. 1 is a perspective view showing a two crown guardrail roadway safety barrier system according to teachings of the present invention.
Figure 2A:
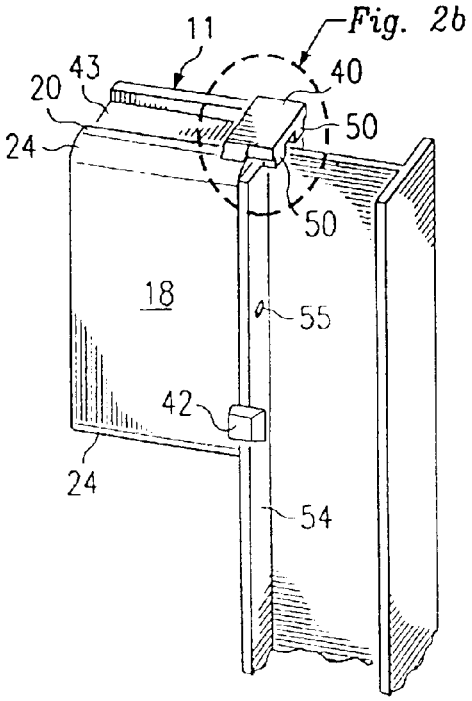
FIG. 2*a* is a perspective view showing a guardrail support assembly according to teachings of the present invention.
Figure 2B:
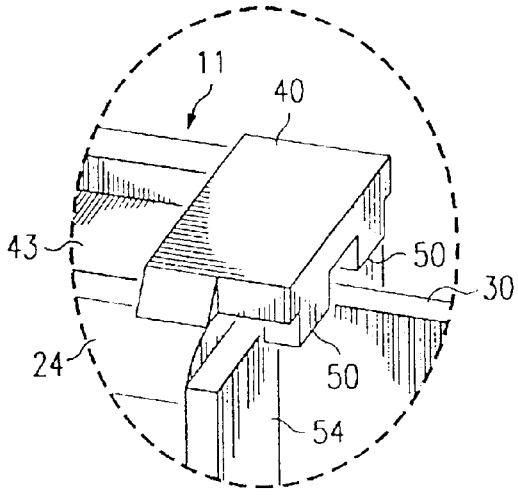
FIG. 2*b* is an expanded view showing the engagement or positioning mechanism of the spacer block illustrated in FIG. 2*a* according to teachings of the present invention.
Figure 15:
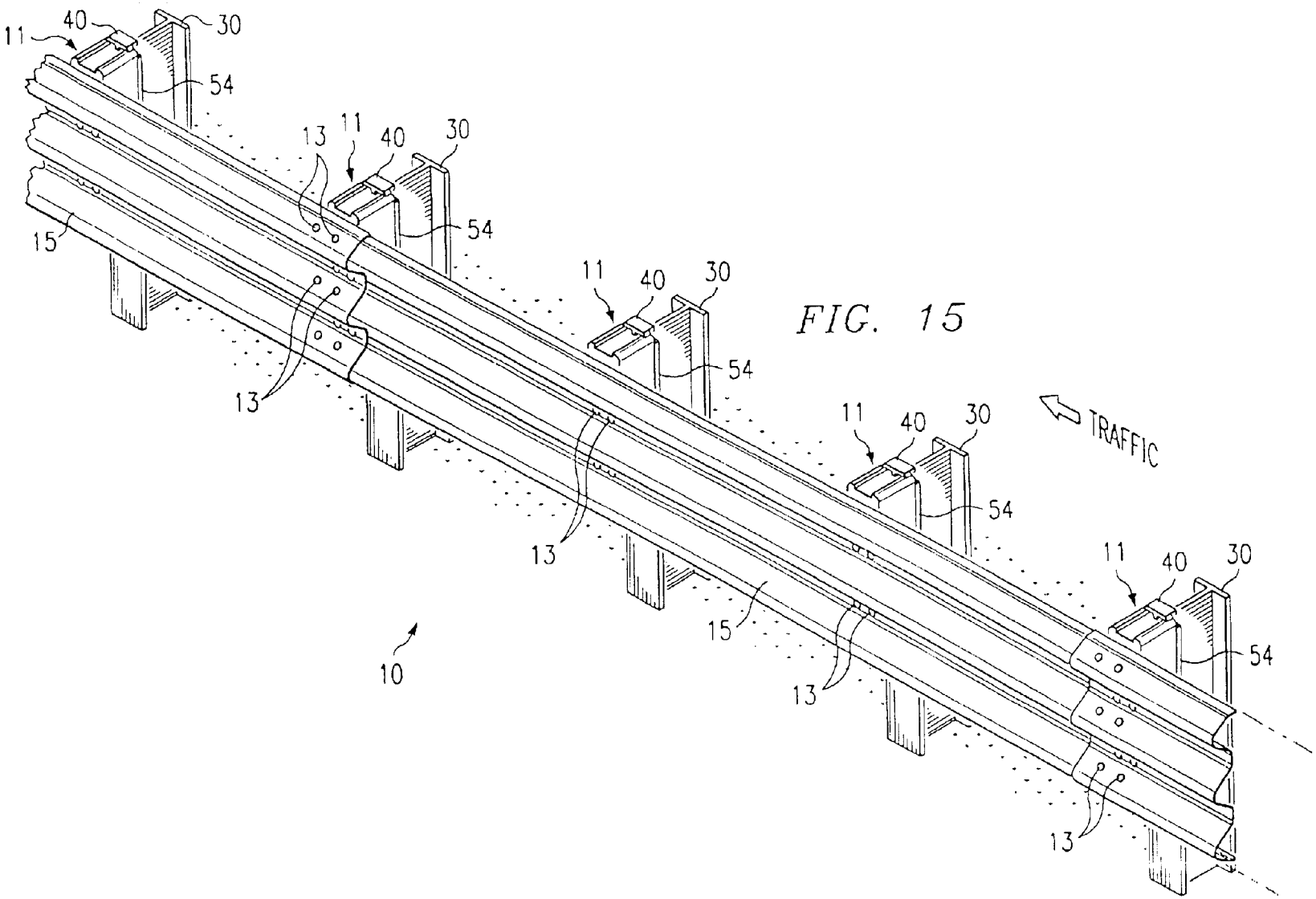
FIG. 15 is a perspective view showing a roadway safety barrier system incorporating thrie-beam guardrails according to teachings of the present invention.

As illustrated in FIGS. 1 through 2*b*, spacer block 11 of the present invention may be mounted to a support post 30, such as an I-beam support post, such that spacer block 11 may cooperatively engage and support a guardrail segment 14 thereon. The roadway safety barrier system 10 of FIG. 1 preferably includes a plurality of spacer blocks 11, support posts 30 and guardrail segments 14. An alternate embodiment of roadway safety barrier system 10 and spacer block 11 for use with thrie-beam guardrail segments 15 is illustrated in FIG. 15 and described in further detail below.

In FIGS. 1 through 4, spacer block 11 is shown with a removable and slidable top tab 40 for engaging a top edge of support post 30. Side tabs 42, illustrated in FIGS. 2*a*, 3 and 4, for preventing lateral movement of spacer block 11 may also be included. In one embodiment, guardrail 14 preferably rests on a bottom or support tab 64, illustrated in FIG. 4, extending from front face 12 of spacer block 11. During installation, bottom tab 64 preferably aids in the support and alignment of guardrail 14 for attachment to support post 30 with one or more attachment mechanisms 13 (e.g., bolts) extending through holes or mounting bores 28 of spacer block 11 and support post 30. Conventional I-beam support posts 30 generally have at least one hole punched into a flange 54 on one side of the support post 30 as illustrated in FIG. 2*a*.

A spacer block 11 for use with conventional two crown ("W") guardrails or other conventional longitudinal rail members is generally shown in FIGS. 1 through 6, 7, 10 and 12 through 14. Such a spacer block 11 is preferably about four (4) inches wide, about seven and one-half (7½) inches deep, and about fourteen (14) inches long.

A spacer block 11 formed in accordance with teachings of the present invention preferably includes front face 12. Front face 12 may be a generally flat solid surface. Alternatively, front face 12 may be webbed, curved, corrugated or formed to correspond to the shape of a guardrail 14. Similarly, rear face 16 may be concave or include a longitudinal depression operable to fit around support posts 30.

Front face 12 is preferably connected to rear face 16 by a pair of spaced apart, opposing side-walls 18 as well as a top panel 20 and a bottom panel 22. The interconnections between side-walls 18, top panel 20, and bottom panel 22 may have rounded shoulders 24, see FIGS. 1 through 4, or squared shoulders 26, see FIG. 5.

Figure 3:
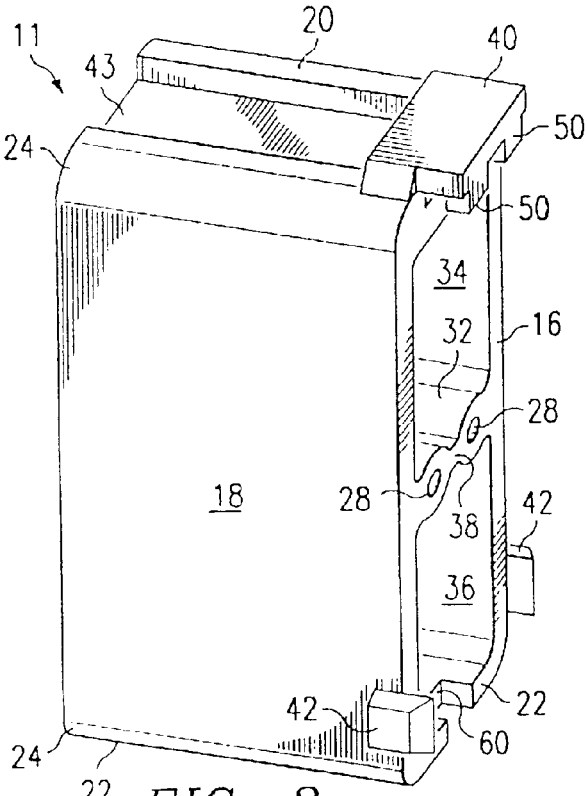
FIG. 3 is a perspective view showing a rear and side of one embodiment of a spacer block according to teachings of the present invention.
Figure 5:
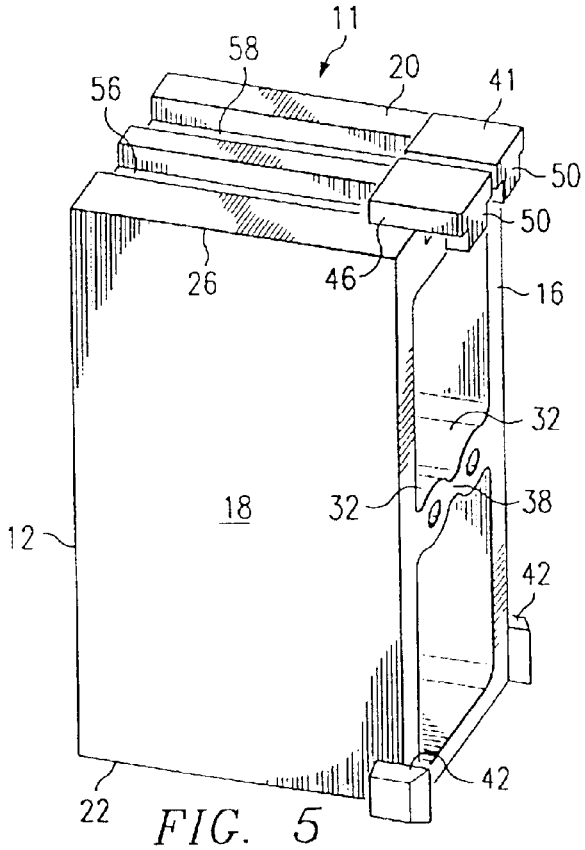
FIG. 5 is a perspective view showing an alternate embodiment of a spacer block according to teachings of the present invention.

As illustrated in FIGS. 3 and 5, spacer block 11 may include a top cavity 34 and a bottom cavity 36 separated by a medial wall 38 horizontally disposed between front face 12 and rear face 16. A pair of mounting bores 28 are preferably disposed proximate to or through medial wall 38. Corded-out cavities 34 and 36 may be reinforced with webbing, solid block materials, gel material, foam, or liquids such as water or glycol, as well as mixtures thereof to aid in the dissipation of stress or impact force.

As mentioned above, one embodiment of spacer block 11 preferably includes a pair of mounting bores 28 formed through medial wall 38. Mounting bores 28 are preferably oriented horizontally, travelling between front face 12 and rear face 16, side by side, to facilitate alignment of the one or more mounting bores 28 with the one or more offset holes 55 preformed in a typical support post 30. Orienting mounting bores 28 as described preferably enables a single installer to position the mounting bores 28 for quick alignment and attachment of a spacer block 11 and guardrail 14 to support post 30.

As illustrated, spacer blocks 11 may include at least one and preferably a plurality of mounting bores 28 extending through front face 12 for cooperative engagement of an attachment mechanism 13 extending through guardrail 14 and spacer block 11, securing their attachment to support post 30. In a preferred embodiment, mounting bores 28 extend through both front face 12 and rear face 16. In addition, mounting bores 28 may extend through medial wall 38 connecting front face 12 and rear face 16. According to teachings of the present invention, a sleeve 32 formed from a cylinder having a bore therethrough may be used as a removable spacer means for insertion between a hole formed in front face 12 and rear face 16. Sleeve 32 preferably abuts an interior surface of front face 12, extends through a cavity formed in the interior of spacer block 11, interconnects with an interior surface of rear face 16 and provides additional structural support.

Spacer block 11, as mentioned above with reference to FIGS. 1 through 4, preferably also includes a top tab 40 fixedly attached to top panel 20. Tab 40 may also be provided as a removable or slidable tab having projections for cooperatively engaging grooves formed in channel 43, such as in a tongue and groove arrangement. Tab 40 preferably extends beyond rear face 16 of spacer block 11 such that spacer block 11 may be engaged with the top of a support post 30 and depend therefrom, see FIGS. 1 through 2*b* and 13 through 15. In alternate embodiments, positioning or engagement tab 40 may comprise a flat plate, a ring to engage a cylindrical post or any other form useful for engaging support post 30 of different configurations according to teachings of the present invention.

The embodiment of engagement tab 40 shown in FIGS. 1 through 5 includes projecting members or fingers 50 extending downward from tab 40, enabling tab 40 to rest on, be positioned on, or otherwise engage the top of an I-beam shaped support post 30. In such engagement, fingers 50 preferably extend behind flange 54 of support post 30 to thereby hold spacer block 11 proximate a mounting position on support post 30.

Figure 4:
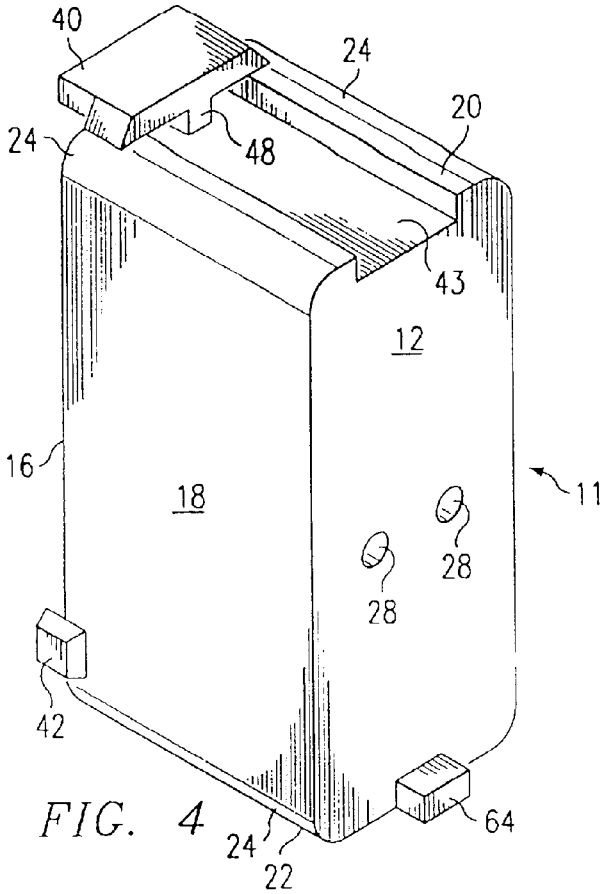
FIG. 4 is a perspective view of the spacer block depicted in FIG. 3 showing a front and side of the spacer block according to teachings of the present invention.
Figure 10:
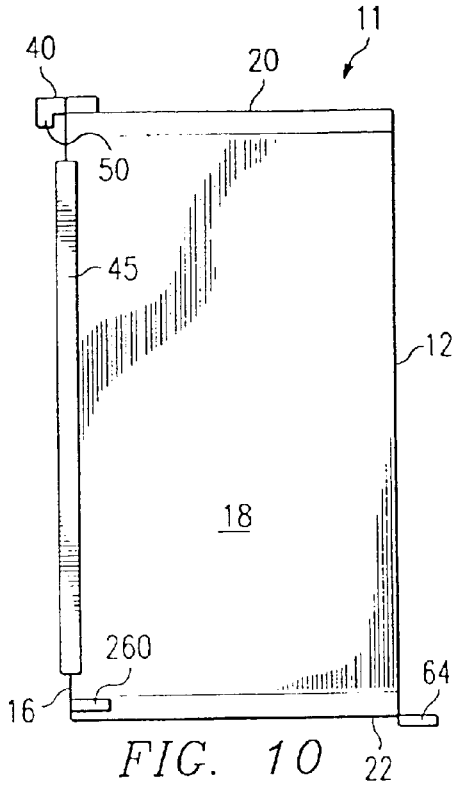
FIG. 10 is a side view of a spacer block formed from structural foam according to teachings of the present invention.

To facilitate a movable positioning tab 40, a groove or channel 43 may be formed or cut in top panel 20 on spacer block 11. As shown in FIG. 4, a leg 48 that extends from a bottom surface of tab 40 and movably engages the top of the channel 43 to provide additional structural support to tab 40 may also be included.

As shown in FIG. 5, first and second channels, 56 and 58 respectively, may be formed in top panel 20 of spacer block 11. Tabs 41 and 46 may be provided, attached to the top surface of top panel 20, and preferably extend beyond rear face 16 of spacer block 11. Similar to top tab 40, tabs 41 and 46 are preferably operable to hold spacer block 11 proximate the top of support post 30 in a mounting position.

Tabs 41 and 46 may also be fabricated such that each is removable or slidable using projections (not expressly shown) to cooperatively engage grooves formed as channels 56 and 58 in a tongue and groove arrangement. Similar to top tab 40, tabs 41 and 46 preferably extend beyond rear face 16 of spacer block 11 and are preferably operable to hold spacer block 11 onto the top of a support post 30. Thus, top tab 40 and tabs 41 and 46 preferably allow a spacer block 11 to hang or depend from a support post 30 during installation of a roadway safety barrier system 10.

A stop means may be incorporated within channels 43, 56 and 58 or attached to the ends thereof. Such a stop means may be desirable to restrict the movement of slidable tabs 40, 41 and 46.

A feature which is very useful and adaptable to the various spacer block 11 embodiments of the present invention are locating and holding or attachment means for cooperatively engaging support post 30 and/or guardrail 14.

As shown in FIGS. 2*a* and 3, one or more side tabs 42 may be used with the spacer blocks 11 of the present invention for cooperatively engaging the vertical sides or flanges 54 of support post 30 and limiting the lateral movement of at least a portion of the spacer block 11. Alternate embodiments of side tabs 42 are illustrated in FIGS. 6 through 14 as side flanges 45. Side tabs 42 or side flanges 45 are preferably spaced apart such that they are generally aligned and generally oppose one another. It is not required that side tabs 42 or side flanges 45 align with one another or that there be a corresponding number of each on the respective sides of spacer block 11. The inclusion of at least one side tab 42 or side flange 45 aids in positioning spacer blocks 11 with respect to the vertical sides or flanges 54 of support post 30. Side tabs 42 or side flanges 45 may be integrally formed on spacer block 11 or attached by a holding means such as a screw or projection for engaging a hole (not expressly shown) formed in spacer block 11. Spacer block 11 may be readily aligned to its proper orientation or in a mounting position through the aid of side tabs 42 or side flanges 45 and tab 40.

Spacer block 11 preferably also includes a support tab 64 operable to support or rest at least a portion of a guardrail 14 thereon. As shown in FIGS. 4, 6, 7 and 10, tab 64 may be provided as an extension from bottom panel 22 or front face 12. Alternate positions of support tab 64 are considered within the scope of the present invention. By allowing guardrail 14 to rest on support tab 64, the alignment of mounting bores 28 with one or more holes in guardrail 14 and support post 30, and the installation of the same, may be simplified.

Figure 7:
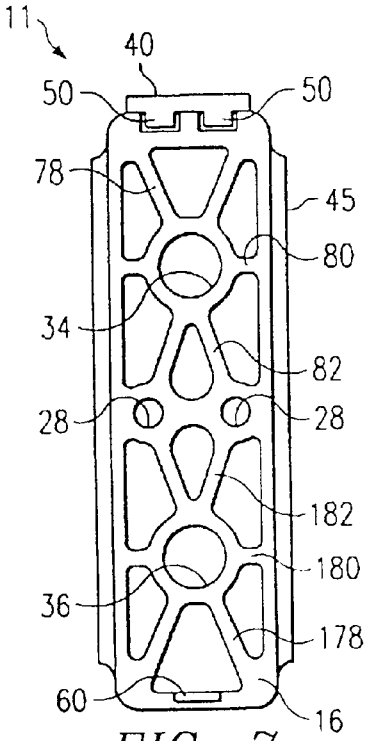
FIG. 7 is a plan view showing an alternate webbing arrangement for a spacer block according to teachings of the present invention.
Figure 9:
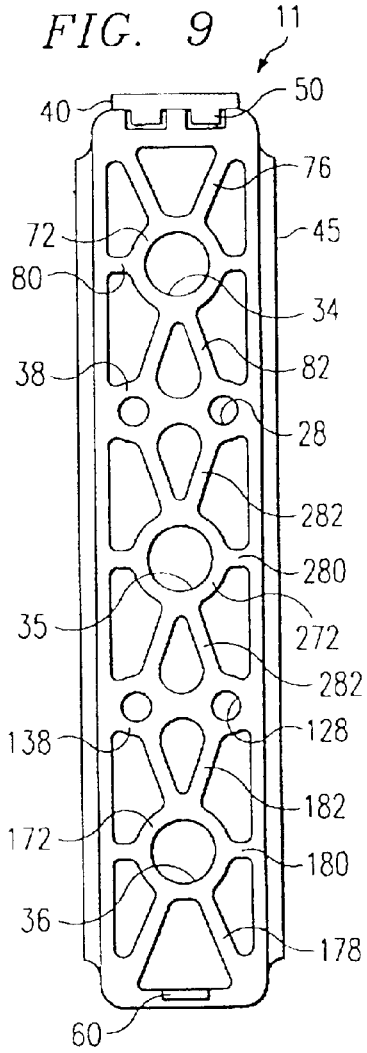
FIG. 9 is a plan view showing a spacer block for use with a thrie-beam guardrail and utilizing a webbed reinforcement arrangement similar to that used in the spacer block shown in FIG. 7 according to teachings of the present invention.
Figure 11:
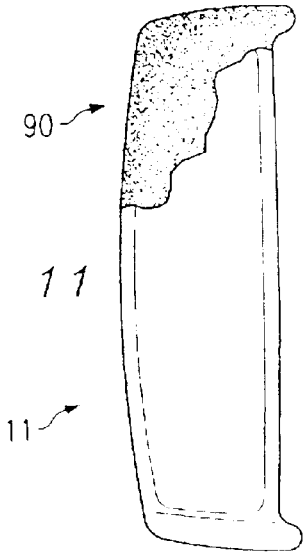
FIG. 11 is a top view, in section, showing a spacer block having a cellular core and an integrated solid skin on each side thereof according to teachings of the present invention.
Figure 12:
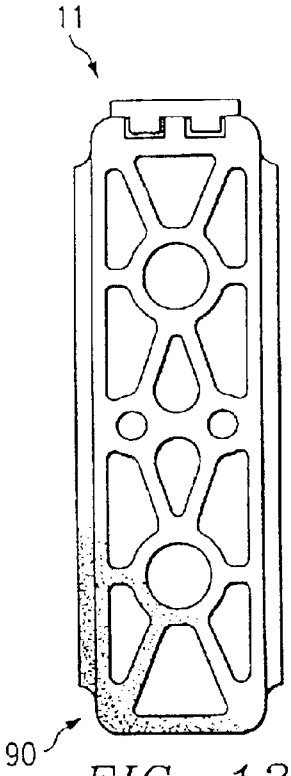
FIG. 12 is a plan view, in section, of the structural foam spacer block illustrated in FIG. 10 showing a cellular core and an integral solid skin, wherein the transition from skin to cellular core is gradual, according to the teachings of the present invention.
Figure 13:
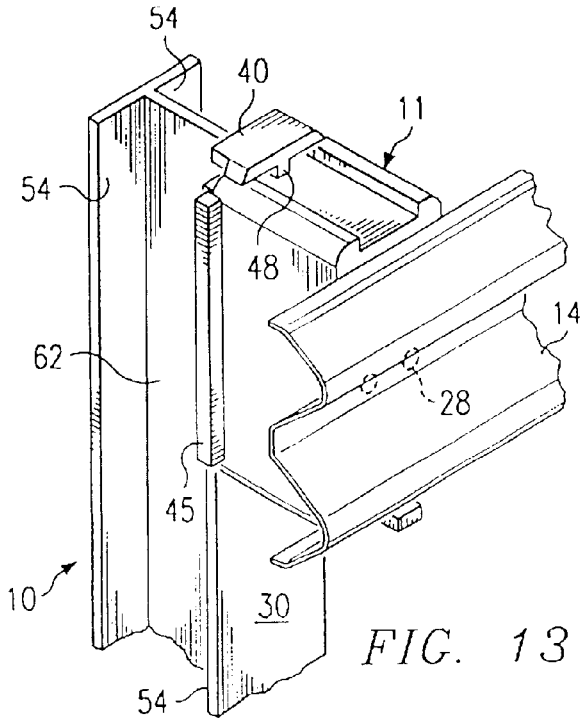
FIG. 13 is a perspective view showing a portion of a two-crown guardrail roadway safety barrier system incorporating a structural foam spacer block according to the teachings of the present invention.
Figure 14:
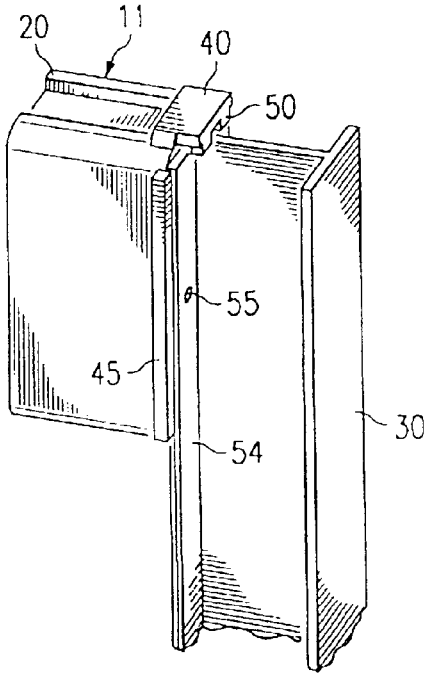
FIG. 14 is a perspective view of a guardrail support assembly incorporating a structural foam spacer block according to the teachings of the present invention.

To permit stacking or nesting of stored spacer blocks 11, as illustrated in FIGS. 3, 7 and 9, a recess or notch 60 may be formed or cut into bottom panel 22, proximate rear face 16. Notch 60 preferably allows for the cooperative engagement of support tab 64 therewith such that spacer blocks 11 may be positioned one upon the other for storage, transport or other purposes.

Spacer block 11 may be formed or molded such that front face 12 is slightly shorter than rear face 16, resulting in top panel 12 and bottom panel 22 inclining toward one another slightly (not expressly shown) at front face 12 to facilitate the removal of spacer block 11 from the mold. Notch or recess 60 of spacer block 11 may also be formed on bottom panel 22 as a declining channel extending from rear face 16 toward front face 12 and preferably does not extend through an interior surface of bottom panel 22.

Spacer blocks 11 built in accordance with teachings of the present invention may be molded into specific embodiments enabling the maximization of structural integrity while maintaining controlled flexibility. These traits may be leveraged by using, among other options, reinforcing webbing, and various rubber and thermoplastic compositions.

Figure 6:
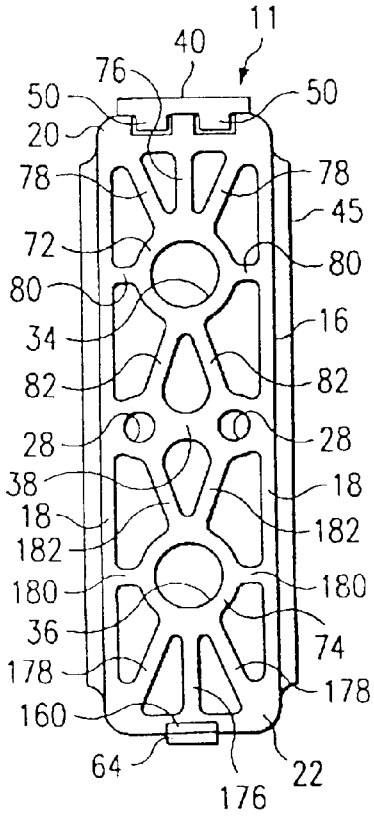
FIG. 6 is a plan view showing the front of one embodiment of a spacer block according to teachings of the present invention.

FIGS. 6 and 7 show alternate embodiments of spacer block 11 of the present invention using webbing within top cavity 34 and bottom cavity 36. Two reinforcing webbing configurations are shown in FIGS. 6 and 7. As illustrated, rear face 16 of spacer block 11 shows webbing formed by combining various lengths of lateral, longitudinal, and transverse members having cavities thereinbetween. The members are preferably positioned to increase structural strength while aiding spacer block 11 in the control of compression and flexing forces. A webbed reinforcement structure preferably also contributes to minimizing the weight of spacer block.

As shown in FIG. 6, one embodiment of spacer block 11 preferably includes webbing which extends from an interior surface of front face 12, through cavity 34 and/or 36, and having a distal end equal in length to side-walls 18, terminating to form rear face 16. In such a webbing configuration, preferably extending from a center of first cavity 34 from the interior surface of front face 12 is first cylindrical reinforcement member 72. A corresponding second cylindrical reinforcement member 74 is preferably included extending from the interior surface of front face 12 through second cavity 36. In each of cavities 34 and 36, the webbing preferably comprises runners extending from first and second cylindrical reinforcing members, 72 and 74 respectively, to the interior surfaces of side-walls 18, top panel 20, bottom panel 22 and medial wall 38.

Specifically as shown in FIG. 6, within first cavity 34, first runner 76 preferably extends between top panel 20 and cylindrical reinforcing member 72. A pair of second runners 78 preferably extend between cylindrical reinforcing member 72 and the corners connecting top panel 20 with side-walls 18. A pair of third runners 80 preferably extend between cylindrical reinforcing member 72 and side-walls 18. A fourth pair of runners 82 preferably extend between cylindrical reinforcing member 72 and medial wall 38, forming a teardrop shaped cavity thereinbetween.

Within second cavity 36 of spacer block 11, illustrated in FIG. 6, is a first runner 176 preferably extending between bottom panel 22 and cylindrical reinforcing member 74. A pair of second runners 178 preferably extend between cylindrical reinforcing member 74 and the corners connecting bottom panel 22 with side-walls 18. A pair of third runners 180 preferably extend between cylindrical reinforcing member 74 and side-walls 18. A fourth pair of runners 182 preferably extend between cylindrical reinforcing member 172 and medial wall 38, forming a teardrop shaped cavity thereinbetween.

The spacer block 11 embodiment illustrated in FIG. 7 has dimensions, features, and webbing similar to the embodiment of spacer block 11 illustrated in FIG. 6. However, the embodiment of spacer block 11 illustrated in FIG. 7 differs from that illustrated in FIG. 6 in that the reinforcement webbing illustrated in FIG. 7 does not utilize runner 76 extending between top panel 20 and cylindrical reinforcing member 74 or the vertical runner 176 extending between bottom panel 22 and cylindrical reinforcing member 74. In addition, the embodiment of spacer block 11 depicted in FIG. 7 includes notch 60 formed in bottom panel 22, proximate rear face 16. As illustrated, notch 60 preferably forms a pocket and does not cut through an exterior surface of bottom panel 22.

Figure 8:
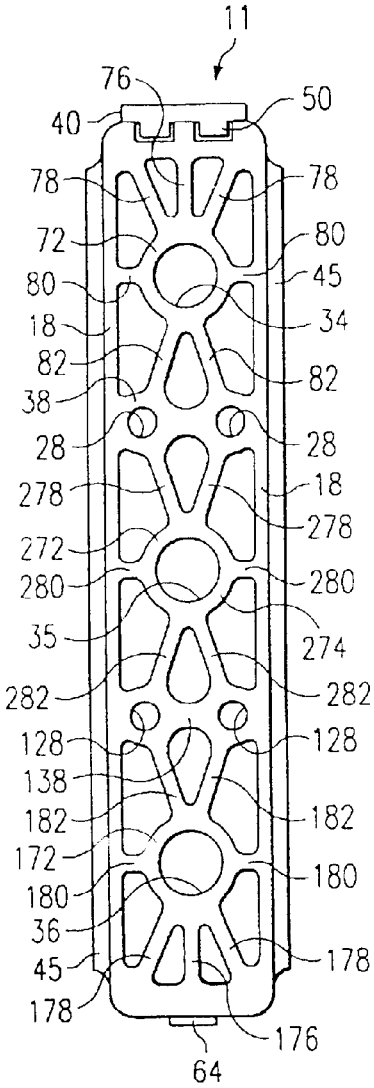
FIG. 8 is a plan view showing a spacer block for use with a thrie-beam guardrail and utilizing a webbed reinforcement arrangement similar to that used in the spacer block shown in FIG. 6 according to teachings of the present invention.

Illustrated in FIG. 8 is an elongated embodiment of a spacer block 11 designed for use with thrie-beam guardrails. Illustration of one embodiment of a roadway safety barrier system 10 using one embodiment of a thrie-beam spacer block 11, as shown in FIG. 8, is depicted in FIG. 15. Elongated spacer block 11 of FIG. 8 preferably includes additional third cavity 35, medial wall 138 and mounting bores 128, disposed between first cavity 34 and second cavity 36. Thrie-beam spacer block 11 of FIG. 8 preferably utilizes substantially the same reinforcing webbing configuration illustrated in FIG. 6. A spacer block 11 designed for use with a thrie-beam guardrail 15, illustrated in FIG. 15, is preferably approximately four (4) inches wide, about twenty-one (21) inches long, and about seven and one-half (7½) to eight (8) inches thick. The depth, length or other dimensions may vary to correspond with the dimensions of a selected guardrail or support post. However, the four (4) inch wide dimension, although not critical, is preferably maintained at about four (4) inches or approximately equal to the thickness of support post 30, excluding side flanges 45 or side tabs 42.

Preferably included within third cavity 35 of elongated spacer block 11 is a pair of runners 278 extending between cylindrical reinforcing member 272 and medial wall 38, forming a teardrop shaped cavity thereinbetween. A pair of runners 280 preferably extend between cylindrical reinforcing member 272 and side-walls 18. A pair of runners 282 preferably extend between cylindrical reinforcing member 272 and medial wall 138, forming a teardrop shaped cavity thereinbetween.

The structural integrity of the various embodiments of the spacer blocks 11 of the present invention may be attributed to the lightweight composite materials and the reinforcing webbing which preferably provide for rigidity and controlled compression of spacer blocks 11 under load.

FIG. 9 shows a second elongated embodiment of spacer block 11 for use with thrie-beam guardrails. See FIG. 15 for one embodiment of a roadway safety barrier system 10 capable of using a thrie-beam spacer block 11 as shown in FIG. 9. As illustrated in FIG. 9, elongated spacer block 11 may include third cavity 35, medial wall 138 and mounting bores 128, disposed between first cavity 34 and second cavity 36. The elongated spacer block 11 of FIG. 9 preferably utilizes substantially the same webbing configuration as the "W" guardrail spacer block 11 embodiment illustrated in FIG. 7. Similar to the elongated spacer block 11 embodiment of FIG. 8, the thrie-beam spacer block 11 illustrated in FIG. 9 is preferably approximately four (4) inches wide, about twenty-one (21) inches long, and about seven and one-half (7½) to eight (8) inches thick. As mentioned above, the depth, length or other spacer block 11 dimensions may vary to correspond to the dimensions of a selected guardrail 15 and/or support post 30. However, the four inch (4) wide dimension, although not critical, is preferably maintained at about four (4) inches or approximately equal to the thickness of a support post 30, excluding any side flanges 45 or side tabs 42.

In addition to or in place of the webbed reinforcement structures described above, it is contemplated that all or at least a portion of a spacer block may be filled with foam, gel, finely ground solid material, or a liquid such as water, alcohol or glycol. Alternatively, one or more of cavities 34, 35 or 36 may contain a bag filled with one or more materials to cushion and absorb impact with a roadway safety barrier system. The materials that may be contained within spacer block 11 or included in a container inserted into the webbing or into one or more of cavities 34, 35 or 36 formed within spacer block 11 may be removable, such as through the use of a water bag or a deformable plastic container such as a jug. In addition, a cellular core may be used for impact absorption within cavities 34, 35 or 36, just as an impact absorbing block filled with cellular material, gel, or a liquid may be disposed within one or more cavities 34, 35 or 36 of spacer block 11 according to teachings of the present invention.

As mentioned above, spacer blocks 11 made in accordance with teachings of the present invention may incorporate a variety of materials into their construction. One embodiment of a spacer block 11 incorporating teachings of the present invention incorporates structural foam into its composition. A structural foam spacer block 11 incorporating teachings of the present invention, such as the structural foam spacer blocks 11 illustrated in FIGS. 10 through 14, is preferably molded and preferably includes a cellular core and an integral solid skin, wherein the transition from skin to core is preferably gradual, as shown generally at 90 in FIGS. 11 and 12. The solid skin preferably gives a molded spacer block 11 its form and toughness, while the cellular core preferably contributes to the attainment of high strength-to-weight characteristics. In one embodiment, the skin of a structural foam spacer block 11 may be up to one-half (½) inch thick. Preferred skin thicknesses range down from one-quarter (¼) inch thick to one-eighth (⅛) inch thick.

In general, there are two basic types of plastics available for creating structural foam spacer blocks 11, thermoset materials and termoplastic materials. Thermoset materials, such as polyurethane, may be produced by polyaddition of reactive components such as polyol and isocyanate. Thermoplastic materials typically require the addition of physical or chemical blowing agents to produce foam and do not undergo chemical change. Some blowing agents decompose when heated to process temperature to evolve a gas such as carbon dioxide. (During processing, the exotherm generated by the reaction vaporizes a blowing agent that causes the mixture to expand.) Often, sodium bicarbonate or ammonium carbonate is used to form cellular or sponge rubber. Halocarbons and methylene chloride may be used in urethane, pentane in expanded polystyrene, and in some cases, hydrazine for foamed plastics.

Spacer blocks 11 using plastic and/or rubber components are generally limited to solid wall thicknesses of about four (4) millimeters. The wall thickness of a structural foam spacer block 11 using plastic and/or rubber components, on the other hand, is preferably not less than about four (4) millimeters in order to gain full advantage of a foam webbing structure between two layers of skin. Thus, greater overall wall thickness may be obtained by using structural foam. Additionally, structural foam spacer blocks 11 have few, if any, sink marks due to residual gas pressure in the cells. This allows the material to expand internally during cooling of the part while holding the skin firmly against the mold walls.

Because of their cellular structure, spacer blocks formed from structural foam are virtually stress-free, resulting in bowing and warping being greatly reduced. In addition, because of its cellular structure, less resin is required during fabrication, which results in a part three (3) to four (4) times more rigid than a solid part of the same weight. Consequently, spacer blocks 11 made in accordance with teachings of the present invention may be made from commodity plastics such as polystyrene and polyethylene with or without rubber in a load bearing application.

Properties of a structural foam spacer block 11 depend on the base polymer, overall part density, density distribution, skin thickness, cell shape and size, among other variables. Each of these variables may be affected by the processing method, process variables, wall thickness, and mold design.

The density of structural foam generally varies across its cross section and is typically lowest in the core. As the distance from the center of a foam block increases, the cells generally get smaller until they "disappear" near the outer skin, see generally at 90 in FIGS. 11 and 12. One objective of such a composition is to produce a part with high skin density, low core density and without the presence of voids. The range of available densities varies in the present invention from about thirty (30) percent in the center to one hundred (100) percent at the outer skin. Also, the overall part density, density distribution, skin thickness, cell shape and size depend upon the mold cycle which may vary between one-half (½) to ten (10) minutes.

A preferred embodiment of spacer block 11 may be formed with a low-pressure injection molding machine using thermoplastics and/or rubber. A screw may be used to plasticate a mixture of polymer and up to one (1) percent chemical blowing agent, preferably up to one-half (½) percent, wherein the screw barrels have zones maintained at different temperatures and are arranged so that the blowing agent is maintained near the nozzle. A foamable mixture may thereby be produced, pumped under pressure to an accumulator and stored in a molten state at a pressure higher than the foaming pressure. Upon opening a valve in the nozzle, a portion of the foamable mixture may be discharged from the accumulator into the mold. The mold cavity is then filled by the gases generated by the decomposition of the chemical blowing agent, forcing the material into the shape of the mold. The pressure and temperature of the material in the mold then drop, resulting in bubbles developing in the core. In a preferred embodiment, the melt is charged at about four hundred (400) degrees Fahrenheit and the melt temperature is between about three hundred and eighty (380) degrees Fahrenheit to four hundred and fifty (450) degrees Fahrenheit. It should be noted that structural foam spacer blocks 11 made in accordance with teachings of the present invention may be made from a rubber compound in combination with a plastic. Preferably, the plastic will encapsulate the rubber particles and act as a binder. The rubber preferably produces enough gas during processing under the heat and pressure of the low-pressure injection molding process that the structural foam product can be made without the addition of any type of chemical blowing agent.

Spacer block 11 of the present invention may be formed by injection molding, preferably low-pressure injection molding, such as is used for structural foam products. Spacer block 11 may include virgin or regrind plastic or combinations thereof without any rubber. The plastic may be selected from such polymers as polyethylene, polypropylene, polyethylene terephthalate, nylon, polyurethane, polyvinyl chloride, ABS, Acetyl, polypropylene oxide, nylon, PBT, polycarbonate, polystyrene, modified polyphenylene oxide, polyester, fiberglass filled nylon, fiberglass filled styrene, fiberglass filled SAN, acrylic, ethylene copolymers, ionomers, and polysulfone. The spacer block 11 of the present invention may be formed from a single type of polymer or mixtures of various polymers. Typically a chemical blowing agent in an amount less than five (5) percent, and preferably in an amount less than one (1) percent and preferably in an amount less than one-half (½) percent may be used with one hundred (100) percent polymer composition spacer blocks 11.

A rubber and/or elastomeric compound may be incorporated in the formulation as a substitution for up to seventy (70) percent, and more preferably less than fifty (50) percent and most preferably from about forty (40) to fifty (50) percent depending upon the strength to weight ratio desired and the structural properties required for a particular application or size of guardrail. Regrind rubber is typically less expensive than plastic materials. Therefore, as much as forty (40) to fifty (50) percent regrind rubber may be used in a spacer block designed for normal impact applications or support posts 30 spaced close together. A composition with less than forty-five (45) percent rubber may be desirable for applications requiring support posts 30 to be spread further apart from one another. The type of rubber may also be an important consideration in that the rubber may be comprised of a natural rubber or synthetic rubber, either virgin material, regrind material or combinations thereof. Additives such as fillers and fiberglass may further reduce the cost of manufacture and provide the requisite strength. Because of the gases produced during injection molding of the rubber particles, the use of a chemical blowing agent is an option and is not required when processing the plastic and rubber mixed compositions.

One material that may be used in the construction of spacer block 11 comprises one or more polymers (such as polyethylene, polypropylene, polyethylene terephthalate, nylon, polyurethane, polyvinyl chloride, and mixtures thereof), and a polymer and rubber blend. Other plastic materials which may be used include, but are not limited to, ABS, Acetyl, polypropylene oxide, nylon PBT, polycarbonate, polystyrene, modified polyphenylene oxide, polyester, fiberglass filled nylon, fiberglass filled styrene, fiberglass filled SAN, acrylic, ethylene copolymers, ionomers, and polysulfone. Spacer block 11 may also be formed from a single polymer or mixtures of various polymers. The polymers used may be virgin material or polymers including regrind materials, such as reground polyethylene, ethylene. The rubber and/or elastomeric compound that may be incorporated may also include a natural rubber or synthetic rubber, either virgin, regrind material or combinations thereof. It is contemplated that fiberglass may also be used as an additive or substitute raw material for all or at least a portion of the plastic material. Fillers such as wood chips, sawdust, calcium carbonate may also be used. The rubber from used tires that has long been a problem for the environment may also be used as a source of rubber for the present invention. In a variety of embodiments, the spacer blocks themselves may be recyclable.

Another embodiment of the present invention comprises polyethylene together with regrind rubber ranging in an amount of up to forty-five (45) percent. Yet another more preferred embodiment utilizes from about thirty (30) to forty-five (45) percent regrind rubber and utilizes ethylene as the binding polymer.

Yet another embodiment utilizes a powdered processing aid from Polymer Process Technologies, Inc. in Akron, Ohio referred to by the trademark PPT-SYS, (PPT-SYS(R) for rubber applications and PPT-SYS(P) for plastic applications), having a specific gravity of about one and one-one hundredth (1.01), a pH of about seven (7), and a melting point range of over six hundred (600) degrees Fahrenheit. Each of these powdered processing aids is a highly effective alloying agent for compatibilizing and alloying cured rubber, virgin or regrind, to form compounds having little or no change in physical properties.

Still another embodiment of spacer block 11 includes a blend of at least one polymer having among its ingredients one or more of the plastic materials set forth herein mixed and molded together with at least one rubber or elastomeric material. The ability to mold large blocks of plastic containing virgin and/or regrind thermoplastics obtained from such sources as reusable containers, alone or together with virgin or grind rubber from used tires or other sources, provides a useful means for the disposal and recycling of waste products. One embodiment utilizes grind rubber in combination with one or more thermoplastics extruded or molded by low-pressure injection molding or vacuum forming. The molding process is believed to encapsulate the rubber particles with the thermoplastic melt thereby providing a stronger blended product with enhanced performance capabilities as compared to a simple mixture of thermoplastic and rubber particles compressed together under high pressure. One source of the grind rubber is used vehicle tires, as indicated above, representing a new method of disposal for used tires.

Another embodiment may contain a non-toxic blend of naturally occurring materials, (plant polymers, gums, and anionic salts), marketed by Polymer process Technologies, Inc., under the trademark of PPT-RNU. When added to post consumer plastics of all kinds, PPT-RNU will typically repair near history plastics to near virgin polymer condition in addition to or instead of the PPT-SYS (R)/(P). This material has a pH of about six and eight-tenths (6.8), a specific gravity of about one and five-hundredths (1.05), a melting point flow of over six hundred and fifty (650) degrees Fahrenheit, and it's generally used in amounts of up to ten (10) percent by weight, and more preferably, from about three (3) percent to about six (6) percent by weight.

Another embodiment utilizes both the PPT-RNU and PPT-SYS additives with rubber and a polymer, such as polyethylene, to enhance the compatibility and performance of regrind rubber from tires being compounded with virgin or recycled polymers such as polyethylene in conventional compounding equipment at processing temperatures of from about three hundred and sixty (360) degrees Fahrenheit to four hundred and ten (410) degrees Fahrenheit which is typical for extrusion and compounding operations.

Although the present invention has been described with respect to a specific preferred embodiment thereof, various changes and modifications may be suggested to one skilled in the art and it is intended that the present invention encompass such changes and modifications fall within the scope of the appended claims.

What is claimed is:

1. A spacer block for attaching a guardrail to a support post, comprising:

a pair of side-walls having respective first and second ends;

a top panel disposed proximate the first end of the side-walls;

a bottom panel disposed proximate the second end of the side-walls;

the top panel, bottom panel and side panels forming a generally rectangular block having respective first and second faces;

at least one mounting bore traveling between the first and second face of the block;

an engagement mechanism slidably engaged with the top panel, the engagement mechanism operable to engage the block with the support post; and a resting mechanism operably coupled proximate the bottom panel, the resting mechanism operable to support a guardrail during assembly.

2. The spacer block of claim 1 further comprising:

a medial wall disposed between the side-walls, the medial wall positioned generally perpendicular to the side-walls and generally parallel to the top and bottom panels;

the medial wall, top panel and side-walls forming a first cavity; and the medial wall, bottom panel and side-walls forming second cavity.

3. The spacer block of claim 2 further comprising:

at least one mounting bore traveling through the medial wall from the first face of the spacer block to the second face of the spacer block; and the mounting bore operable to align with at least one mounting aperture on the support post.

4. The spacer block of claim 2 further comprising a reinforcement structure disposed in at least one of the cavities.

5. The spacer block of claim 2 further comprising a webbing structure disposed within at least one of the cavities, the webbing structure operable to structurally reinforce the spacer block.

6. The spacer block of claim 1 further comprising:

first and second medial walls disposed generally perpendicular to the side-walls and generally parallel to the top and bottom panels;

the first medial wall, side-walls and top panel creating a first cavity;

the first medial wall, second medial wall and side-walls forming a second cavity; and the second medial wall, side-walls and bottom panel forming a third cavity.

7. The spacer block of claim 6 further comprising:

at least one mounting bore disposed in the first medial wall, the mounting bore traveling between the first and second faces of the spacer block; and at least one mounting bore disposed in the second medial wall, the mounting bore traveling between the first and second faces of the spacer block.

8. The spacer block of claim 1 further comprising:

the engagement mechanism including a tab operably coupled to the top panel, the tab extending beyond the second face of the spacer block;

at least two spaced apart fingers operably coupled proximate a distal end of the tab, the fingers extending from a bottom surface of the tab and forming a gap between the fingers and the second face of the spacer block; and the gap between the fingers operable to engage respective sides of a web on an I-beam support post and the gap between the fingers and the second face of the spacer block operable to engage respective sides of a flange on the I-beam support post.

9. The spacer block of claim 1 further comprising:

the resting mechanism including a tab disposed proximate the bottom panel, the tab extending from the first face of the spacer block; and the tab operable to support a guardrail thereon during assembly of a roadway safety barrier system.

10. The spacer block of claim 1 further comprising an alignment mechanism operably coupled to at least one side-wall.

11. The spacer block of claim 1 further comprising the first face including a generally flat solid surface.

12. The spacer block of claim 1 wherein the spacer block is formed, at least in part, using a structural foam.

13. The spacer block of claim 1 further comprising the engagement mechanism removably engaged with the top panel.

14. The spacer block of claim 1 further comprising the bottom panel including a notch disposed proximate the second face of the spacer block, the notch operable to allow stacking of the spacer blocks.

15. The spacer block of claim 1 wherein the spacer block includes at least one polymer.

16. The spacer block of claim 1 wherein the spacer block is formed using an injection molding process.

* * * * *